US008742241B2

(12) United States Patent
Irimura

(10) Patent No.: US 8,742,241 B2
(45) Date of Patent: Jun. 3, 2014

(54) ELECTRONIC KEYBOARD INSTRUMENT

(71) Applicant: Kabushiki Kaisha Kawai Gakki Seisakusho, Hamamatsu (JP)

(72) Inventor: Kohtaro Irimura, Hamamatsu (JP)

(73) Assignee: Kabushiki Kaisha Kawai Gakki Seisakusho, Hamamatsu-Shi (JP)

( * ) Notice: Subject to any disclaimer, the term of this patent is extended or adjusted under 35 U.S.C. 154(b) by 0 days.

(21) Appl. No.: 13/869,714

(22) Filed: Apr. 24, 2013

(65) Prior Publication Data

US 2013/0283998 A1 Oct. 31, 2013

(30) Foreign Application Priority Data

Apr. 27, 2012 (JP) ..... 2012-103275

(51) Int. Cl.
*G10C 3/12* (2006.01)
*G10C 3/02* (2006.01)

(52) U.S. Cl.
CPC ..... *G10C 3/02* (2013.01)
USPC ..... 84/423 R

(58) Field of Classification Search
USPC ..... 84/423 R
See application file for complete search history.

(56) References Cited

U.S. PATENT DOCUMENTS

| | | | | |
|---|---|---|---|---|
| 2,852,973 | A * | 9/1958 | Corbett, Jr. | 84/423 R |
| 5,335,283 | A * | 8/1994 | Torii | 381/118 |
| 5,483,861 | A * | 1/1996 | Kawamura et al. | 84/719 |
| 7,060,890 | B2 * | 6/2006 | Sato et al. | 84/745 |
| 7,329,812 | B2 * | 2/2008 | Kuwahara et al. | 84/744 |
| 8,039,725 | B2 * | 10/2011 | Kato et al. | 84/744 |
| 8,193,438 | B2 * | 6/2012 | Hoshino | 84/644 |
| 8,338,688 | B2 * | 12/2012 | Shinjo | 84/719 |
| 2010/0288110 | A1 * | 11/2010 | Hoshino | 84/744 |
| 2012/0222541 | A1 * | 9/2012 | Ishimura et al. | 84/744 |
| 2013/0283998 | A1 * | 10/2013 | Irimura | 84/423 R |
| 2013/0305899 | A1 * | 11/2013 | Nagatsuma et al. | 84/423 R |

FOREIGN PATENT DOCUMENTS

JP 2000-81885 3/2000

* cited by examiner

*Primary Examiner* — Robert W Horn
(74) *Attorney, Agent, or Firm* — Christie, Parker & Hale, LLP

(57) ABSTRACT

An electronic keyboard instrument capable of suppressing warpage of a keybed having a keyboard placed thereon and improving the appearance of the instrument by shared use of a backboard covering an instrument body and a speaker box. A piano body of an electronic piano has a keybed. A bottom board is disposed below the keybed in a manner spaced therefrom and extends further rearward than a rear end thereof. A front board is erected on a front end of the bottom board and connected to the keybed. The speaker box accommodates a speaker. A screen board is erected rearward of the front board in the speaker box on the bottom board, and connected to the keybed. A backboard is connected to the rear end of the bottom board in a manner covering the rear sides of the piano body and the speaker box.

5 Claims, 3 Drawing Sheets

ELECTRONIC KEYBOARD INSTRUMENT

CROSS-REFERENCE TO RELATED APPLICATION

This application claims priority to and the benefit of Japanese Patent Application Number 103275/2012, filed on Apr. 27, 2012, the entire disclosure of which is incorporated herein by reference.

BACKGROUND OF THE INVENTION

1. Field of the Invention

The present invention relates to an electronic keyboard instrument, such as an electronic piano, and more particularly to an electronic keyboard instrument having a speaker box accommodating speakers and disposed under an instrument body including a keyboard, etc.

2. Description of the Related Art

Conventionally, as an electronic keyboard instrument of the above-mentioned type, there has been known one disclosed in Japanese Laid-Open Patent Publication (Kokai) No. 2000-81885. The electronic keyboard instrument has an instrument body accommodating a keyboard, etc. and a speaker box accommodating a speaker and disposed under the speaker body. The instrument body is formed into a box shape by connecting a keybed, a top board, left and right arms, and a backboard to each other. The keybed has an opening formed therein at a location corresponding to the speaker.

The speaker box is an unitary assembly formed by combining a bottom board, a top board, a front board, and a backboard each extending in a left-right direction. The speaker is mounted on the bottom board, and an opening is formed in the bottom board such that the sound emission surface of the speaker faces the opening. The top board is formed with a plurality of communication holes.

The speaker box constructed as above is fixed to an instrument stand in a state sandwiched between the left and right side boards of the instrument stand. The instrument body is placed on the instrument stand and fixed to the same, whereby the electronic keyboard instrument is assembled. Musical sound generated by key depression is output from the sound emission surface of the speaker and emitted from the opening formed in the bottom board of the speaker box. The musical sound is also output from other portions of the speaker and emitted from the communication holes of the top board of the speaker box and the opening of the keybed.

However, in this conventional electronic keyboard instrument, the keybed having the keyboard, etc. placed thereon has its outer peripheral portions connected to the arms and the backboard, and is supported on the instrument stand. Therefore, there is a fear that the keybed is largely warped due to a large load e.g. from the keyboard, which can cause degradation of the appearance of the keyboard and malfunction of keys. Further, since the keybed is formed with the opening for guiding musical sound output from the speaker into the instrument body, the rigidity of the keybed is reduced, which causes a further increase in warpage of the keybed.

Furthermore, the instrument body and the speaker box are formed separately from each other, the back boards of these have to be mounted separately. For this reason, two separate backboards appear on the rear surface of the electronic keyboard instrument, and the number of screws for fixing the backboards is increased, which causes degradation of the appearance of the electronic keyboard instrument. In addition, since the backboards are in contact with the keybed, vibration of the speaker box caused by output of sound from the speaker is transmitted from the keybed to the backboards, which can generate noise, such as rattle noise. Therefore, it is required to take a soundproofing measure e.g. by providing a vibration-proof cushion between the keybed and the backboards.

SUMMARY OF THE INVENTION

It is an object of the present invention to provide an electronic keyboard instrument which makes it possible not only to suppress warpage of a keybed by properly supporting the keybed having a keyboard placed thereon, but also to improve the appearance of the electronic keyboard instrument by shared use of a backboard for covering an instrument body and a speaker box.

To attain the above object, the present invention provides an electronic keyboard instrument comprising an instrument body including a horizontal keybed on which is placed a keyboard including a large number of keys arranged side by side in a left-right direction, a speaker box having a bottom board disposed below the keybed in a manner spaced therefrom and extending further rearward than an rear end of the keybed, and a front board erected on a front end of the bottom board and connected to the keybed, the speaker box accommodating a speaker for outputting musical sound, a screen board disposed in the speaker box at a location rearward of the front board in a manner spaced therefrom, such that the screen board is erected on the bottom board and is connected to the keybed, and a backboard connected to a rear end of the bottom board such that the backboard covers a rear side of the instrument body and a rear side of the speaker box.

According to this electronic keyboard instrument, the speaker box accommodating the speaker is disposed below the keybed of the instrument body, on which the keyboard is placed. The speaker box has the bottom board and the front board erected on the front end of the bottom board, and the front board is connected to the keybed. Further, in the speaker box, the screen board is disposed rearward of the front board in a manner spaced therefrom. The screen board is also erected on the bottom board and connected to the keybed. With this arrangement, the keybed having the keyboard placed thereon is properly supported by the front board and the screen board of the speaker box at two locations in the front-rear direction, with excellent balance, so that it is possible to sufficiently suppress warpage of the keybed e.g. due to load from the keyboard to thereby maintain the good appearance of the keyboard and the excellent operations of the keys.

Further, the bottom board of the speaker box extends further rearward than the rear end of the keybed, and the rear end of the bottom board is connected to the backboard covering the rear sides of the instrument body and the speaker box. Thus, the keybed is properly supported by the front board and the screen board, so that it is possible to prevent occurrence of a problem that the keybed is excessively warped, even though the keybed is connected to the bottom board alone without being connected to the backboard. Further, since the keybed and the backboard are not in contact with each other, vibration of the keybed caused by vibration of the speaker box is not transmitted to the backboard. Therefore, differently from the prior art, it is possible to dispense with a special soundproofing measure for preventing noise due to the vibration. Furthermore, the backboard is formed by the single board shared by the instrument body and the speaker box, so that it is possible to improve the appearance of the electronic keyboard instrument in comparison with a conventional case where two backboards are separately provided for an instrument body and a speaker box, respectively.

What is more, a gap formed between the keybed and the backboard can be used as a passage for wiring and a sound transmission hole for guiding musical sound output from the speaker into the instrument body. This eliminates the need to form an opening or a hole in the keybed for the same purpose. Therefore, it is possible to omit machining of an opening or the like in the keybed and a troublesome wiring operation performed via the opening or the like. In addition, since the rigidity of the keybed is maintained, it is possible to suppress warpage of the keybed more reliably.

Preferably, a printed circuit board for generating musical sound is mounted on a rear surface of the screen board.

With the arrangement of this preferred embodiment, the printed circuit board is mounted on the rear surface of the screen board, and hence it is possible to easily access the printed circuit board from behind e.g. in a state where the backboard is removed, to thereby remove or wire the printed circuit board with ease.

More preferably, a keyboard chassis supporting the large number of keys is placed on the keybed, and the electronic keyboard instrument further comprises a first conductive sheet laid between the keybed and the keyboard chassis, and a second conductive sheet laid between the rear surface of the screen board and the printed circuit board and electrically connected to the first conductive sheet.

With the arrangement of this preferred embodiment, it is possible to take an electrostatic countermeasure and an electric wave countermeasure effectively, by widely dispersing static electricity generated on the printed circuit board or the keyboard chassis and high-frequency electric current as a cause of electromagnetic interference, over the whole first conductive sheet or the whole second conductive sheet. As a consequence, the need to provide additional conductive sheets for making the conductive sheets electrically connected, e.g. on the backboard and the side boards of the speaker box, is eliminated, which contributes to reduction of a material cost for conductive sheets and installation man-hours.

Preferably, a keyboard chassis for supporting a larger number of keys and a hammer chassis connected to a rear end of the keyboard chassis and supporting a large number of hammers each configured to pivotally move in accordance with depression of an associated one of the keys are placed on the keybed, and the screen board is disposed at a location corresponding to an area close to the rear end of the keyboard chassis.

With the arrangement of this preferred embodiment, since the hammer chassis for supporting the large number of hammers is connected to the rear end of the keyboard chassis for supporting the numerous keys, load acting on the keybed is particularly large at a location of the keybed close to the rear end of the keyboard chassis. According to the present invention, the screen board is disposed at the location corresponding to the area close to the rear end of the keyboard chassis to thereby support the portion of the keybed on which a particularly large load acts, so that it is possible to more effectively obtain the same advantageous effect described above.

The above and other objects, features, and advantages of the present invention will become more apparent from the following detailed description taken in conjunction with the accompanying drawings.

DETAILED DESCRIPTION OF PREFERRED EMBODIMENTS

Figure 1B:
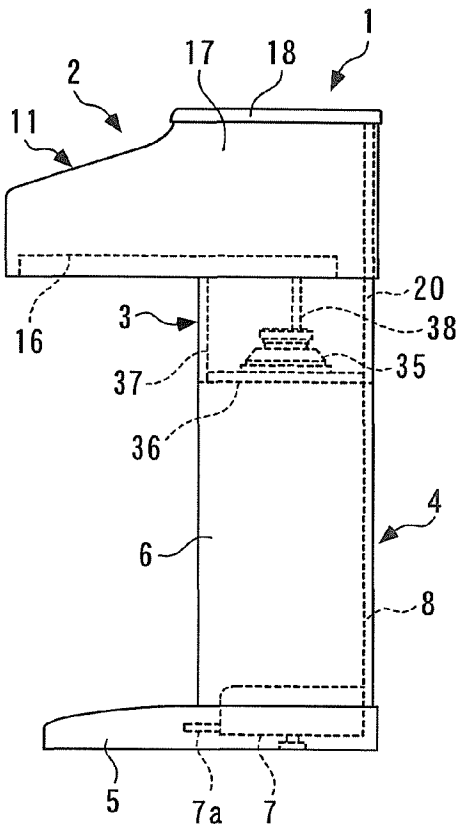
FIG. 1B is a side view of the electronic piano shown in FIG. 1A.
Figure 1A:
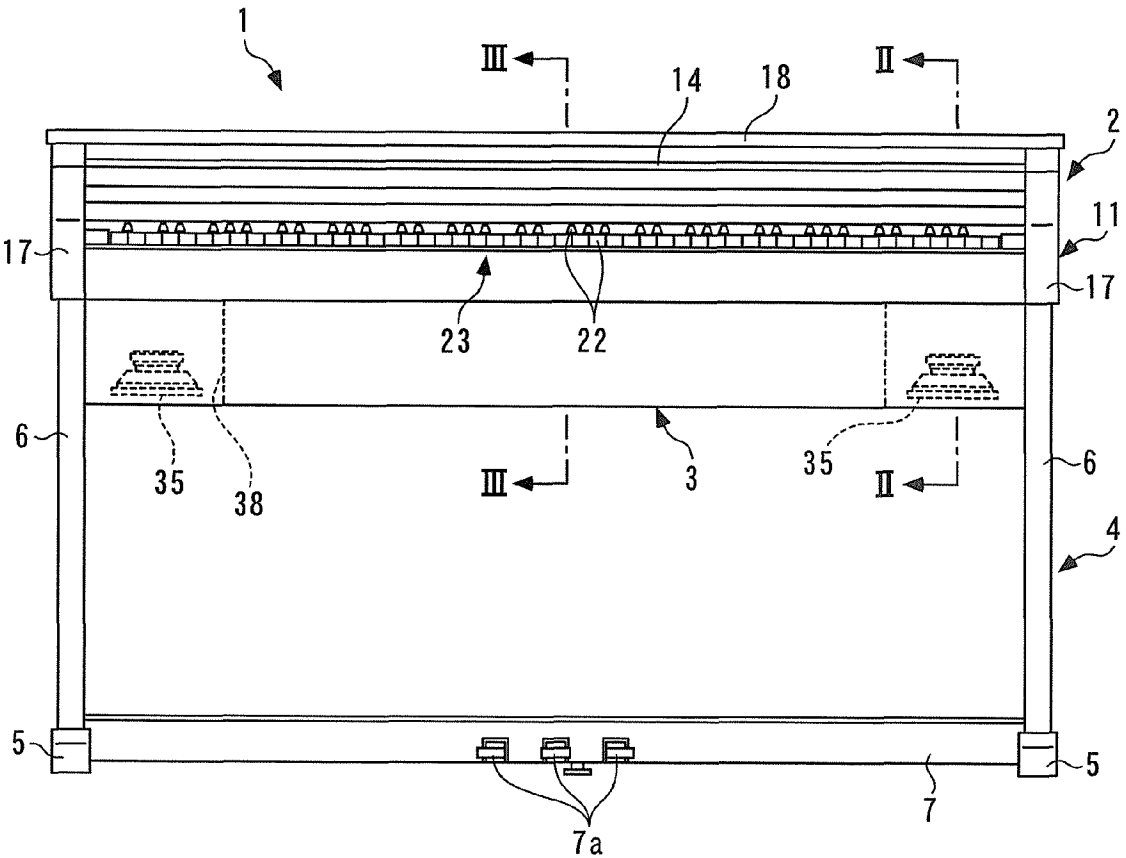
FIG. 1A is a front view of an electronic piano according to an embodiment of the present invention.

The present invention will now be described in detail with reference to the drawings showing a preferred embodiment thereof. As shown in FIGS. 1A and 1B, an electronic piano 1 to which the present invention is applied comprises a piano body 2, a speaker box 3 disposed under the piano body 2, and a stand 4 for supporting the piano body 2 and the speaker box 3. In the following description, a near side, a far side, a left side, and a right side of the electronic piano 1 as viewed from a player will be referred to as "front", "rear", "left", and "right", respectively.

The stand 4 comprises left and right toe blocks 5 and 5 each extending in the front-rear direction, left and right side boards 6 and 6 each extending upward from the respective toe blocks 5 and 5, a pedal base 7 connecting between the lower ends of the respective toe blocks 5 and 5, and a stand backboard 8 for covering a rear side of the stand 4 between the side boards 6 and 6. In the central portion of the pedal base 7, there are arranged three pedals 7*a*.

The piano body 2 includes a body case 11, a keyboard device 12 accommodated in the body case 11, and a fallboard 14 for opening and closing the body case 11.

The body case 11 is formed into a box shape by connecting a horizontal keybed 16 having a rectangular shape, left and right arms 17 and 17, a top board 18, and a backboard 20 to each other. The backboard 20 covering the rear side of the keybed 16 and the respective arms 17 and 17 extends downward beyond the keybed 16 to cover the rear side of the speaker box 3 as well. In short, the backboard 20 is formed by a single board shared by the piano body 2 and the speaker box 3. The keybed 16 has a rear end thereof located forward of the rear end of the top board 18. Consequently, the keybed 16 is not directly connected to the backboard 20, and a gap G is formed therebetween.

The keyboard device 12 includes a metal keyboard chassis 21 disposed on the keybed 16, a keyboard 23 comprising a plurality of keys (white keys and black keys) 22 supported on the keyboard chassis 21, a metal hammer chassis 24 connected to the rear end of the keyboard chassis 21 and extending upward, a plurality of hammers 25 (only one of which is shown) rotatably supported by the hammer chassis 24, and a key switch 26 disposed on the hammer chassis 24 to detect key depression information on the keys 22.

Between the keybed 16 and the keyboard chassis 21 and the hammer chassis 24, there is laid a first conductive sheet 51 made of a conductive material, such as aluminum. The first conductive sheet 51 is stuck to the keybed 16 to cover an upper surface thereof, and extends around the rear end and along a lower surface of the keybed 16 to cover the rear end and the bottom surfaces thereof, and along rear and lower surfaces of a wood piece 16*a* attached to the lower surface of the keybed 16 to cover the rear and lower surfaces of the wood piece 16*a*.

Each of the keys 22 is basically made of a wood material similarly to each key of an acoustic piano. Each of the keys 22 has a balance pin hole 22*a* formed in a central portion thereof in the front-rear direction, and a large number of balance pins 27 are arranged side by side on the keyboard chassis 21 in the left-right direction. The key 22 is supported on the keyboard chassis 21 with an associated one of the balance pin holes 22*a* engaged with an associated one of the balance pins 27, such that the key 22 can vertically swing. Further, on the front of the keyboard chassis 21, there are erected a plurality of front pins 28 in a manner arranged side by side in the left-right direction, and a front pin hole 22*b* formed in the front of each of the keys 22 is engaged with an associated one of the front pins 28, whereby the key 22 is prevented from swinging horizontally during vertical swing thereof.

Each of the hammers 25 is pivotally supported by a hammer support 24*a* of the hammer chassis 24 and placed on the rear end of an associated one of the keys 22. When the key 22 is depressed, the associated hammer 25 is pushed up by the key 22 and pivotally moves upward. The key switch 26 comprises a rubber switch having a plurality of contacts. When pressed by a hammer 25 having been pivotally moved upward by key depression, the key switch 26 detects key depression information including depression of the associated key 22 and key depression speed.

The fallboard 14 is of a slide type. The fallboard 14 has guide pins 29 (only one of which is shown) protruding outward from the respective left and right ends of the front portion thereof and rotatable pinions 30 (only one o which is shown) provided on the respective left and right ends of the rear portion thereof. On the other hand, each of the left and right arms 17 and 17 has the front portion of an inner surface thereof formed with a guide groove 31 extending along the outer periphery thereof, and the rear portion formed with a rack 32 extending in the front-rear direction. The guide pins 29 of the fallboard 14 are engaged with the respective guide grooves 31, and the pinions 30 are in mesh with the respective racks 32. With this arrangement, the fallboard 14 slides in the front-rear direction while being guided by the left and right guide grooves 31 and the left and right racks 32.

Next, a description will be given of the construction of the speaker box 3 of the electronic piano 1 as the electronic musical instrument according to the present invention. As shown in FIGS. 1A and 1B, the speaker box 3 is disposed adjacent to the lower side of the piano body 2 in a manner extending over the whole distance between the left and right side boards 6 and 6.

Figure 2:
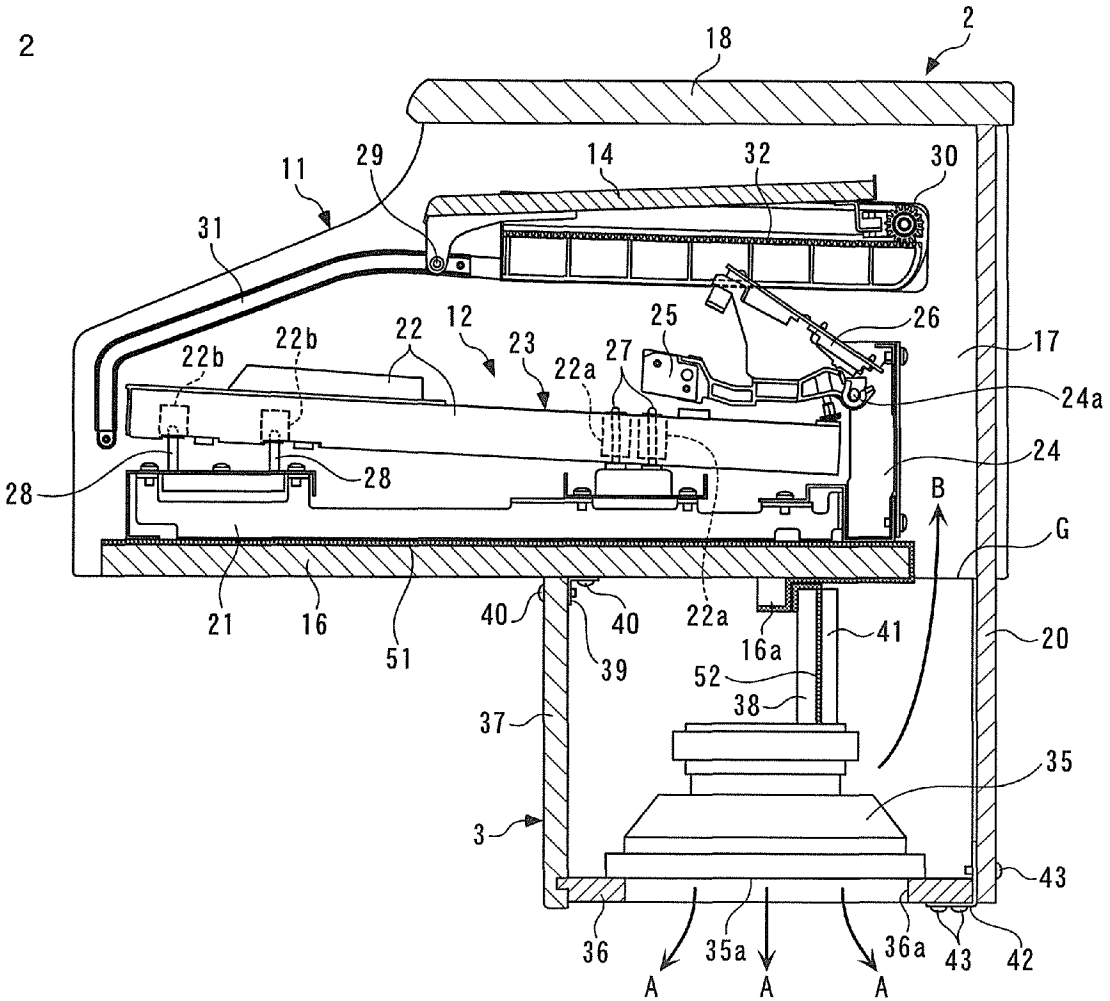
FIG. 2 is an enlarged partial cross-sectional view taken on line II-II of FIG. 1A.
Figure 3:
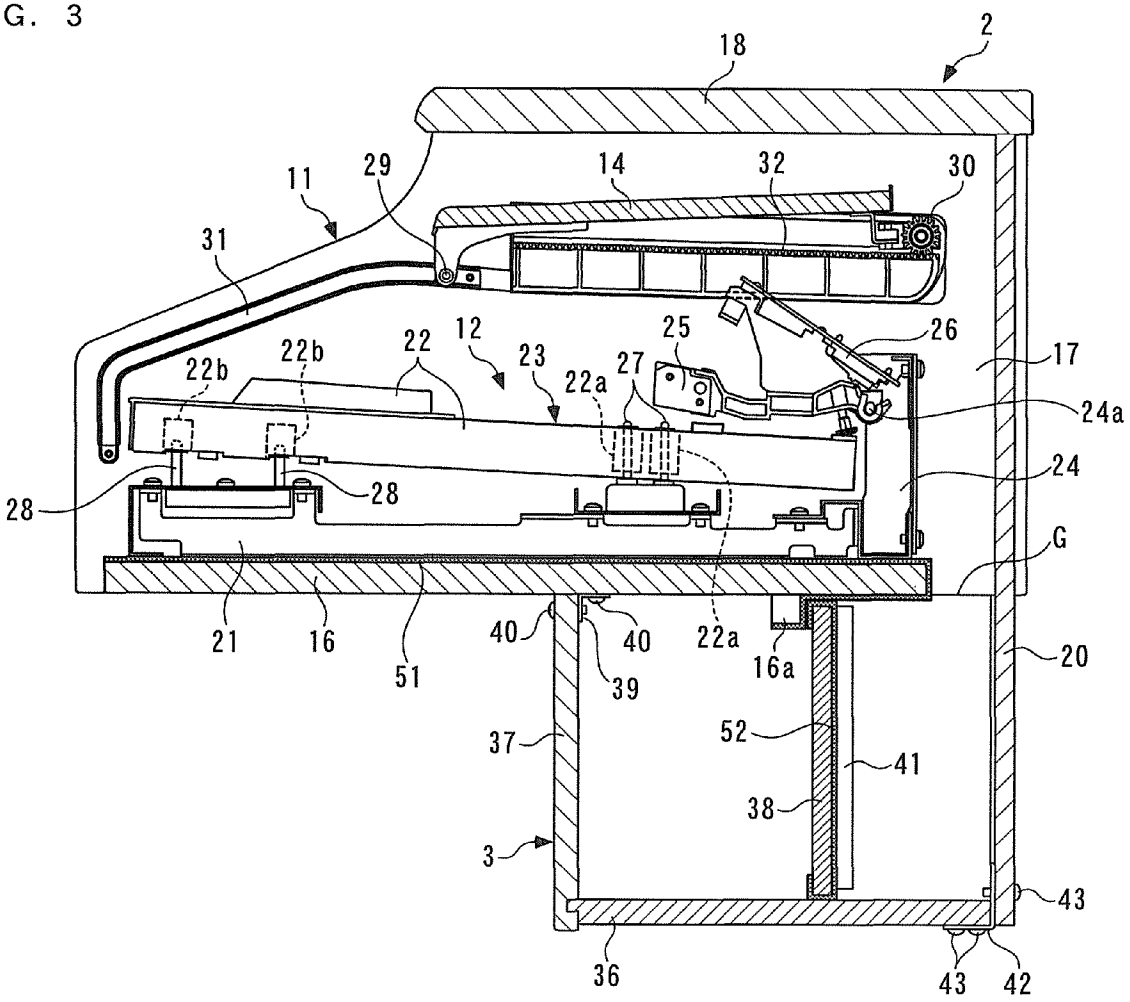
FIG. 3 is an enlarged partial cross-sectional view taken on line III-III of FIG. 1A.

As shown in FIG. 2, the speaker box 3 is formed by a horizontal bottom board 36 disposed below the keybed 16 with a space from the same, and a front board 37 erected from the front end of the bottom board 36, and has an L shape in cross section.

The length of the bottom board 36 in the front-rear direction is substantially the same as that of the side board 6 of the stand 4, and approximately half that of the keybed 16. The bottom board 36 is disposed at a location corresponding to the rear half of the keybed 16. The bottom board 36 has left and right ends formed with circular sound emission holes 36*a*, respectively.

The front board 37 has its lower end integrally connected to the front end of the bottom board 36. Further, the front board 37 is fixed to a central portion of the keybed 16 in the front-rear direction with a plurality sets of L brackets 39 and screws 40 (only one set is shown) at a plurality of respective locations in the left-right direction.

The speaker box 3 accommodates left and right speakers 35 and 35, and has a screen board 38 provided therein. The speakers 35 and 35 are disposed in the respective left and right end areas of the speaker box 3, and are each mounted on the bottom board 36 with its sound emission surface 35*a* facing the associated sound emission hole 36*a* from above.

The screen board 38 is disposed in the speaker box 3 in a manner extending in the left-right direction over an area except the left and right end areas where the speakers 35 and 35 are disposed, respectively (see FIG. 1A). The screen board 38 is erected on the bottom board 36 at a location corresponding to an area close to the rear end of the keyboard chassis 21 adjacent to the hammer chassis 24 in a manner spaced rearward from the front board 37 of the speaker box 3. The screen board 38 is fixed to the bottom board 36 at a plurality of portions of the lower end in the left-right direction with L brackets and screws (none of which are shown) and to the rear end of the keybed 16 at a plurality of portions of the upper end with screws (not shown) via the wood piece 16*a*.

Further, in the speaker box 3, there are provided a printed circuit board 41 and other electronic circuit components, and a tone generator including acoustic components (not shown), such as an amplifier. The printed circuit board 41 is mounted on the rear surface of the screen board 38. The printed circuit board 41 and the key switch 26 are connected to each other by conductive wires (not shown). The conductive wires are passed through the gap G between the keybed 16 and the backboard 20.

Between the rear surface of the screen board 38 and the printed circuit board 41 is laid a second conductive sheet 52 identical in configuration to the first conductive sheet 51 described hereinbefore. The second conductive sheet 52 is stuck to the screen board 38 to cover the rear surface thereof, and extends around the upper end and lower end to the front thereof to cover surfaces thereof. With this construction, the second conductive sheet 52 is held in contact with the first conductive sheet 51 and made conductive, in a state where the screen board 38 is mounted to the keybed 16 via the wood piece 16*a*. Therefore, it is possible to dispense with wiring for electrically connecting between the two conductive sheets 51 and 52.

As described hereinbefore, the backboard 20 is formed by the single board extending over the whole length of the body case 11 of the piano body 2 and the speaker box 3. The backboard 20 is fixed to the left and right arms 17 and 17 and the bottom board 36 of the speaker box 3 with a plurality of sets of L brackets 42 and screws 43 in a manner covering the whole rear surface of the body case 11 and that of the speaker box 3.

With this arrangement, a signal indicative of key depression information detected by the key switch 26 is input to the printed circuit board 41 via the conductive wires, and musical sound generated by the tone generator based on the signal is output from the sound emission surface 35*a* and the rear surface of the left or right speaker 35. As indicated by arrows A in FIG. 2, musical sound output from the sound emission surface 35*a* of the speaker 35 is emitted downward from the electronic piano 1 via the sound emission hole 36*a*. On the other hand, musical sound output e.g. from the rear surface of the speaker 35 is propagated into the body case 11 through the gap G between the keybed 16 and the backboard 20 as indicated by an arrow B in FIG. 2, and is further, e.g. via a gap between the fallboard 14 and the front end of the top board 18, emitted forward from the electronic piano 1.

The piano body 2 and the speaker box 3 constructed as above are assembled into a state shown in FIG. 2 and then mounted to the stand 4. Specifically, the speaker box 3 is fitted between the left and right side boards 6 and 6 of the stand 4, and in a state where the arms 17 and 17 of the piano body 2 are placed on the side boards 6 and 6, each of the arms 17 and 17, an associated one of the front board 37 of the speaker box 3, and an associated one of the side boards 6 and 6 are fixedly connected to each other with L brackets and screws (none of which are shown), whereby the electronic piano 1 shown in FIG. 1 is assembled. In this state, the piano body 2 and the backboard 20 of the speaker box 3 are continuous with the stand backboard 8.

As described above, according to the present embodiment, the keybed 16 having the keyboard chassis 21 and the hammer chassis 24 placed thereon is properly supported by the front board 37 of the speaker box 3 and the screen board 38 at two locations in the front-rear direction, so that it is possible to sufficiently suppress warpage of the keybed 16 e.g. due to load from the keyboard 23 and the hammers 25 to thereby maintain the good appearance of the keyboard 23 and the excellent operations of the keys 22 and the hammers 25. Further, the screen board 38 is disposed at a location corresponding to a location close to the rear end of the keyboard chassis 21 adjacent to the hammer chassis 24 in the body case 11, and hence supports a portion of the keybed 16 where particularly large acting load is received. This makes it possible to obtain the advantageous effect mentioned above, more effectively.

Further, the keybed 16 is properly supported by the front board 37 and the screen board 38, so that it is possible to prevent occurrence of a problem that the keybed 16 is excessively warped, even though the keybed 16 is not connected to the backboard 20. Furthermore, the gap G between the keybed 16 and the backboard 20 can be used as a passage for wiring and a sound transmission hole for guiding musical sound output from the speaker 35 into the body case 11. This eliminates the need to form an opening or a hole in the keybed 16 for the same purpose. Therefore, it is possible to omit machining of an opening or the like in the keybed 16 and a troublesome wiring operation performed via the opening or the like. In addition, since the rigidity of the keybed 16 is maintained, it is possible to suppress warpage of the keybed 16 more reliably.

Further, since the keybed 16 and the backboard 20 are not in contact with each other, vibration of the keybed 16 caused by vibration of the speaker box 3 is not transmitted to the backboard 20. Therefore, differently from the prior art, it is possible to dispense with a special soundproofing measure taken e.g. by providing a vibration-proof cushion between the keybed 16 and the backboard 20 so as to prevent noise due to the vibration of the keybed 16.

Furthermore, the backboard 20 is formed by the single board shared by the piano body 2 and the speaker box 3, so that it is possible to improve the appearance of the electronic piano 1 in comparison with a conventional case where two backboards are separately provided for a piano body and a speaker box, respectively. Additionally, since the printed circuit board 41 is mounted on the rear surface of the screen board 38, it is possible to easily access the printed circuit board 41 from behind e.g. in a state where only the backboard 20 is removed, to thereby remove or wire the printed circuit board 41 with ease.

What is more, the first conductive sheet 51 is laid between the keybed 16 and the keyboard chassis 21, and the second conductive sheet 52 is laid between the screen board 38 and the printed circuit board 41, with the two conductive sheets 51 and 52 electrically connected to each other. This makes it possible to take an electrostatic countermeasure and an electric wave countermeasure effectively, by widely dispersing static electricity generated on the printed circuit board 41 or the keyboard chassis 21 and high-frequency electric current as a cause of electromagnetic interference, over the whole first conductive sheet 51 or the whole second conductive sheet 52. As a consequence, the need to provide additional conductive sheets for making the respective conductive sheets 51 and 52 electrically connected, e.g. on the backboard 20 and the side boards of the speaker box 3, is eliminated, which contributes to reduction of a material cost for conductive sheets and installation man-hours.

It should be noted that the present invention is by no means limited to the embodiment described above, but it can be practiced in various forms. For example, although in the above-described embodiment, the printed circuit board 41 is mounted on the rear surface of the screen board 38, this is not limitative, but the printed circuit board 41 may be mounted on the upper surface of the bottom board 36. Further, although in the above-described embodiment, the electronic keyboard instrument of the present invention is described as the electronic piano having hammers, by way of example, this is not limitative, but the present invention may be applied to another type of electronic piano or an electronic keyboard instrument, such as an electronic organ.

It is further understood by those skilled in the art that the foregoing is a preferred embodiment of the invention, and that various changes and modifications may be made without departing from the spirit and scope thereof.

What is claimed is:

1. An electronic keyboard instrument comprising:

an instrument body including a horizontal keybed on which is placed a keyboard including a large number of keys arranged side by side in a left-right direction;

a speaker box having a bottom board disposed below the keybed in a manner spaced therefrom and extending further rearward than an rear end of the keybed, and a front board erected on a front end of the bottom board and connected to the keybed, said speaker box accommodating a speaker for outputting musical sound;

a screen board disposed in said speaker box at a location rearward of the front board in a manner spaced therefrom, such that said screen board is erected on the bottom board and is connected to the keybed; and a backboard connected to a rear end of the bottom board such that said backboard covers a rear side of said instrument body and a rear side of said speaker box.

2. The electronic keyboard instrument according to claim 1, wherein a printed circuit board for generating musical sound is mounted on a rear surface of said screen board.

3. The electronic keyboard instrument according to claim 2, wherein a keyboard chassis supporting the large number of keys is placed on the keybed, the electronic keyboard instrument further comprising a first conductive sheet laid between the keybed and the keyboard chassis, and a second conductive sheet laid between the rear surface of said screen board and the printed circuit board and electrically connected to said first conductive sheet.

4. The electronic keyboard instrument according to claim 1, wherein a keyboard chassis for supporting a larger number of keys and a hammer chassis connected to a rear end of the keyboard chassis and supporting a large number of hammers each configured to pivotally move in accordance with depression of an associated one of the keys are placed on the keybed, and wherein said screen board is disposed at a location corresponding to an area close to the rear end of the keyboard chassis.

5. The electronic keyboard instrument according to claim 2, wherein a keyboard chassis for supporting a larger number of keys and a hammer chassis connected to a rear end of the keyboard chassis and supporting a large number of hammers each configured to pivotally move in accordance with depression of an associated one of the keys are placed on the keybed, and wherein said screen board is disposed at a location corresponding to an area close to the rear end of the keyboard chassis.

* * * * *